US006847000B1

(12) United States Patent
Marchini et al.

(10) Patent No.: US 6,847,000 B1
(45) Date of Patent: Jan. 25, 2005

(54) NEGATIVE RATE SNAP-ACTING SWITCH APPARATUS AND METHOD

(75) Inventors: Michael G. Marchini, Freeport, IL (US); Edward L. Stern, Lanark, IL (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 10/714,010

(22) Filed: Nov. 14, 2003

(51) Int. Cl.[7] ..... H01H 5/00
(52) U.S. Cl. ..... 200/402; 200/409
(58) Field of Search ..... 200/401–409, 200/447–452, 454, 458, 460, 468, 283, 290

(56) References Cited

U.S. PATENT DOCUMENTS

| | | | | | |
|---|---|---|---|---|---|
| 3,604,879 | A | * | 9/1971 | Beer | 200/335 |
| 3,989,914 | A | * | 11/1976 | Stearley et al. | 200/453 |
| 4,032,734 | A | | 6/1977 | Burch | 200/67 DA |
| 4,587,387 | A | | 5/1986 | Piguet | 200/67 D |
| 4,644,115 | A | | 2/1987 | Nishimori et al. | 200/67 D |
| 5,017,747 | A | * | 5/1991 | Nagahara et al. | 200/453 |
| 5,262,752 | A | | 11/1993 | Truong et al. | 337/373 |
| 5,467,523 | A | | 11/1995 | Seaman | 29/622 |
| 5,555,972 | A | | 9/1996 | Schwab | 200/451 |
| 5,752,811 | A | * | 5/1998 | Petro | 417/416 |
| 5,790,010 | A | * | 8/1998 | Schwab | 337/365 |
| 5,913,415 | A | * | 6/1999 | Kishi et al. | 200/456 |
| 5,941,371 | A | | 8/1999 | Kautz et al. | 200/318 |
| 5,950,811 | A | | 9/1999 | Kautz et al. | 200/407 |
| 6,496,097 | B2 | | 12/2002 | Frank | 337/323 |
| 6,522,228 | B2 | * | 2/2003 | Wellner et al. | 335/18 |
| 6,525,641 | B1 | | 2/2003 | Frank | 337/365 |
| 6,528,748 | B2 | | 3/2003 | Harris et al. | 200/81.9 |
| 6,538,553 | B2 | | 3/2003 | Yu | 337/365 |
| 6,542,056 | B2 | * | 4/2003 | Nerstrom et al. | 335/17 |

* cited by examiner

*Primary Examiner*—Elvin Enad
*Assistant Examiner*—Lisa Klaus
(74) *Attorney, Agent, or Firm*—Kris T. Fredrick

(57) ABSTRACT

A negative rate snap-acting switch apparatus and method is disclosed, which generally includes a plunger associated with an actuating lever, a stationary anchor, a moveable contact, and at least two stationary contacts. The negative rate snap-acting switch apparatus also includes a snap-spring assembly reactive to the actuating lever, wherein the snap-spring assembly is assembled into the stationary anchor and the actuating lever to form a spring-anchor-lever assembly thereof including a central spring member loaded into an axial compression and persuaded to bend into a post-buckled elastic mode shape thereof to form a negative rate snap-acting switch apparatus in which the moveable and the stationary contacts are responsive to an actuating force derived from the snap-spring assembly.

20 Claims, 10 Drawing Sheets

NEGATIVE RATE SNAP-ACTING SWITCH APPARATUS AND METHOD

TECHNICAL FIELD

Embodiments are generally related to switching devices. Embodiments are also related to snap-action switches.

BACKGROUND OF THE INVENTION

Unacceptable electrical switching performance can result in switching applications where the actuation force varies slightly below the switch actuating force or slightly above its de-actuating force for indefinite periods of time. For reliable and predictable electrical switching performance, it is desirable to maintain maximum contact force until the point of actuation or de-actuation. In non-snap switches and the vast majority of precision, snap-action switches, contact forces are at a maximum at the plunger free position (i.e., plunger fully extended) and the full over-travel position (i.e., plunger fully depressed).

Contact force diminishes to zero as the switch apparatus approaches the operating point, the plunger position at which the switch changes electrical state from the normally-closed (NC) circuit to the normally-open circuit (NO). Likewise, contact force decreases to zero as the switch apparatus approaches its release point, the plunger position at which the switch changes state from the NO circuit back to the NC circuit. As the contact force varies at or near zero, the switch is susceptible to intermittent non-contact, welding of contacts, and excessive heat generation and contact erosion.

In addition, once actuation or de-actuation commences, it is desirable that the switch apparatus moves from free position to full over-travel position, or vice versa, in one continuous motion. The uninterrupted switch apparatus motion from free position to full over travel results in a minimum amount of time spent near zero contact force and in a maximum relative movement between the moveable contact and the stationary contacts between switching events.

One example of a switching application where the actuating force can vary slightly below the switch actuating force is a mechanical thermostat. A temperature sensitive bimetal spring expands and contracts in response to changes in the surrounding environmental temperature. If a non-snap or typical snap-action switch is directly actuated by the bimetal, it is quite possible the force supplied by the bimetal can vary slightly below the switch actuating force for long periods of time. In such an application, the electrical performance of a non-snap or typical snap-action is likely to be unacceptable.

FIG. 1 illustrates a graph 100 depicting plunger force versus displacement behavior typical of a conventional snap-action switch that may have a total movement range as low as 0.5 millimeters to as high as 2 millimeters for total plunger travel depending on the overall size and design of the snap spring mechanism. The shape of the plunger force-deflection curve increases in linear fashion from a near zero plunger force at the free position (point A) up to operate position (point B) at which time the force between the common moveable contact and the normally closed stationary contact becomes zero. When the switch plunger reaches the operate position (point B), stored energy in the switch apparatus can cause a "snap-over" of the common moveable contact from the normally closed to the normally open stationary contact. The plunger force thereafter drops to point C.

If the plunger is moved further, the plunger force can again increase in linear fashion as indicated by line C-D in FIG. 1. When the plunger is gradually released, the plunger force retraces back along line D-C and continues beyond to the release point E where the contact force between the common moveable contact and the normally open stationary contact again becomes zero. At the release point E, stored energy within the switch apparatus is used to "snap-back" the common moveable contact to the normally closed stationary contact while the plunger force experiences a sudden increase from point E to point F. Releasing the plunger further then causes the plunger force to retrace along line FA back to free position point A.

Low total travel switch designs with nearly linear and positive plunger force deflection spring rates are known as high precision snap-action switches. The linear and increasing plunger force with displacement behavior allows for precise adjustment during production of plunger operate or release force and the amount of differential travel between operate and release positions for the plunger. Differential travel is often adjusted to within 0.0005 inch of a desired value by moving the position of the normally closed stationary contact, which in turn changes the air gap distance the moveable contact, must travel during "snap-over" and "snap-back". The position of a stationary anchor used to pre-load one member of the snap spring in compression can be moved a small amount to adjust plunger operate or release force to within 10 grams of a desired force level.

Because of precise operating characteristics, low travel, positive rate snap-switch apparatus have often been the switching mechanism of choice when accurate, reliable, and repeatable control of switching functions are required. Such switch control requirements are common in applications involving a pressure or temperature stimulus where accurate and narrow control of a pressure or temperature differential is desired. The low and slow actuation forces produced by pressure and temperature responding resilient members in control applications, however, have caused electrical switching performance issues for conventional high precision, positive rate snap-switch apparatus.

FIG. 2 illustrates a graph 200 depicting plunger force-deflection behavior for many medium travel switch designs having a total plunger travel movement from 2 to 3 millimeters. In graph 200, the plunger force is a substantial value at the switch free position but less than the required plunger force at point B to operate the snap-action mechanism. In the plunger pre-travel range from point A to point B the slope of the curve is still positive but much closer to a zero slope than the low travel, high precision switch designs discussed previously. In the plunger over-travel range from point C to point D the slope of the force-deflection curve may be somewhat positive, zero, or even negative depending on the design of the switch apparatus. Along with the lower slopes, the plunger force-travel curves may exhibit some non-linearity in their shape.

Although medium travel switch apparatus exist with low plunger operate forces, their pre-travel slopes are positive and require a resilient pressure or temperature reacting member to generate an increasing force up to the operate point B in order to actuate the snap switch. A creep-type opening of the electrical contact interface is still a real possibility along with the electrical performance issues.

The low positive slope and nonlinear behavior of the plunger force-deflection curve during plunger pre-travel make it difficult to adjust medium travel switch designs for precise operating characteristics. Many medium travel switch designs are assembled in production without any adjustment of plunger force or differential travel. In addition the differential travel of the moveable contact for a given air gap or "break distance" of a medium travel switch tends to be larger and exhibit more variation than the low travel, high precision switch apparatus. Using a positive rate switch with too large a plunger differential travel for a pressure or temperature control device can unacceptably widen the control range. For these reasons medium plunger travel snap switch designs are not seriously considered for use in pressure and temperature control devices.

FIG. 3 illustrates a graph 300 depicting a force-deflection curve representative of a conventional high plunger travel switch design. The large total plunger travel up to 5 millimeters magnifies the nonlinear shape of the plunger force versus travel curve such that positive and negative slope portions exist in both the pre-travel (point A to B) and the over-travel (point C to D) range for plunger travel. The maximum plunger force during the pre-travel range usually occurs at some distance prior to the plunger travel reaching operate position (point B) or "snap-over".

The negative slope or decreasing rate of plunger force before reaching operate position is desirable for rapidly moving through the "snap-over" point and into the over-travel region before the plunger again begins to experience increasing force resistance to movement. If total plunger travel movement is restricted to just the negative slope portion of the plunger force versus travel curve then the creep-type opening and closing of the moveable contact will not occur and the unreliable electrical switching performance problems mentioned previously are no longer a concern.

To achieve a negative rate portion for the plunger force-deflection curve centered in the middle of the large total travel range requires rather large and lengthy snap spring geometry. The snap spring length may become 1.5 inches in length or longer and when mounted in some type of case or housing with stationary contacts can grow to 1.8 inches or more in overall length. The length dimension of a high travel switch design usually becomes too large to fit within the space available of many pressure switch and thermostat housing bodies.

FIG. 4 illustrates a graph 400 depicting a contact force, in accordance with an embodiment of the present invention. Graph 400 of FIG. 4 illustrates how contact force, or the force between the moveable contact and stationary contact interface, can vary with the plunger travel position for conventional snap-switch apparatus with low and medium total plunger travel designs. As the switch plunger is actuated from free position (point A) to the operate position (point B) the force of the common moveable contact against the normally closed stationary contact decreases in near linear fashion from free position point A down to zero at the operate position point B.

At the plunger operate position (point B), "snap-over" of the moveable contact to the normally open stationary contact occurs and the contact force is then represented by point C. Depressing the switch plunger further causes contact force on the normally open stationary contact to increase linearly toward the plunger full over-travel position (point D). As the switch plunger is released, the contact force retraces from point D back to point C and beyond to the release position (point E). Here the moveable contact "snaps-back" to the normally closed stationary contact with a force represented by point F. Further release of the switch plunger causes the contact force to retrace from point F to the free position point A.

For high plunger travel switch apparatus, the contact force also diminishes to zero at the switch plunger operate point but may exhibit considerable non-linearity in the shape of the contact force path. The shape of the contact force versus plunger travel curve can become sinusoidal for large travel switch apparatus. The important fact to realize is that as the switch plunger approaches the operating or release position, the contact force decreases and reaches zero at the instant the moveable contact separates from the stationary contact. In switch applications involving slow plunger actuation motion (i.e., creep-like plunger velocity) the switch apparatus can remain near the impending operate position with near zero contact force for a long period of time.

Such a condition can cause non-contact (e.g., dead-break) because not enough force exists at the interface of the mechanically closed contacts to conduct sufficient current to energize the device being controlled by the switch. Low contact force also allows high electrical resistance at the contact interface to develop that can lead to excessive heating and softening and perhaps melting of the contact materials. Once the plunger reaches operate position point B, the moveable contact may not transfer with a sudden snap-like action if plunger velocity is too low.

Because internal pivot or bearing friction may be present within the switch apparatus, the moveable contact may stall for some time during the transfer to the opposite stationary contact side, with unacceptable arcing or a period of electrical non-conduction occurring. After the moveable contact completes the transfer across the air gap and strikes the opposite stationary contact, the moveable contact may bounce off the stationary contact for a short time when plunger actuation velocity is slow. Excessive contact bouncing during contact closure aggravates contact welding, as each successive bounce during closure can generate heat and create an opportunity for a weld to form.

Oftentimes when a positive rate switch apparatus is used to provide the switching function in a slow responding pressure or temperature control device, a snap action interface means is used to help quickly move the switch plunger through the operate and release positions where the contact force goes to zero. Devices are known, for example, where a Belleville spring provides a negative spring rate interface between a pressure driven diaphragm and the switch in order to speed up the switching of the moveable contact and improve electrical performance.

All of the aforementioned designs and configurations provide unacceptable switching performance that can result in switching applications where the actuation force varies slightly below the switch actuating force or slightly above its de-actuating force for indefinite periods of time. Embodiments are thus described herein which overcome such drawbacks.

BRIEF SUMMARY OF THE INVENTION

The following summary of the invention is provided to facilitate an understanding of some of the innovative features unique to the present invention and is not intended to be a full description. A full appreciation of the various aspects of the invention can be gained by taking the entire specification, claims, drawings, and abstract as a whole.

It is, therefore, one aspect of the present invention to provide an improved switching apparatus.

It is also an aspect of the present invention to provide an improved snap-action switch apparatus.

It is a further aspect of the present invention to provide a negative-rate switch apparatus.

It is additionally an aspect of the present invention to provide a switch apparatus that overcomes problems associated with unacceptable electrical switching performance resulting from switching applications in which the actuation force varies slightly below the switch actuating force or slightly above its de-actuating force for indefinite periods of time.

The aforementioned aspects of the invention and other objectives and advantages can now be achieved as described herein. A switch apparatus is disclosed, which generally includes a plunger associated with an actuating lever, a stationary anchor, a moveable contact, and at least two stationary contacts. The switch apparatus also includes a snap-spring assembly reactive to the actuating lever, wherein the snap-spring assembly is assembled into the stationary anchor and the actuating lever to form a spring-anchor-lever assembly thereof including a central spring member loaded into an axial compression and persuaded to bend into a post-buckled elastic mode shape thereof to form a switch apparatus in which the moveable and the at least two stationary contacts are responsive to an actuating force derived from the snap-spring assembly.

In general, a downward depression of the plunger causes the actuating lever via an actuating force to move a hinged portion of the actuating lever upward along an arc thereby causing compression of the central spring member, resulting in a snap-action contact between the moveable contact and at least one of two stationary contacts for completion of an electrical circuit thereof. The switch apparatus moves in a continuous uninterrupted motion from a first position of stability to a second position of stability when the actuation force is resilient and of a desired rate. The switch apparatus can function as a negative-rate switch, wherein a highest plunger force occurs at a free position and a lowest plunger force occurs at a full over-travel position thereof.

The switch contact force of the switch apparatus is at a maximum point when the plunger is in the free position. The switch contact force can also be a maximum point when the plunger is at the full over-travel position. The plunger moves without interruption through a full range of travel thereof when a resilient actuating force of an appropriate rate overcomes the free position plunger force. The negative-rate switch overcomes a resilient actuating force and returns the plunger to a free position without interruption when the resilient actuating force of an appropriate rate drops slightly below a full over-travel plunger force thereof. The switch apparatus also provides a negative plunger force deflection spring rate that is linear in slope throughout a total plunger travel.

BRIEF DESCRIPTION OF THE DRAWINGS

The accompanying figures, in which like reference numerals refer to identical or functionally-similar elements throughout the separate views and which are incorporated in and form a part of the specification, further illustrate the present invention and, together with the detailed description of the invention, serve to explain the principles of the present invention.

DETAILED DESCRIPTION OF THE INVENTION

The particular values and configurations discussed in these non-limiting examples can be varied and are cited merely to illustrate at least one embodiment of the present invention and are not intended to limit the scope of the invention.

Figure 5:
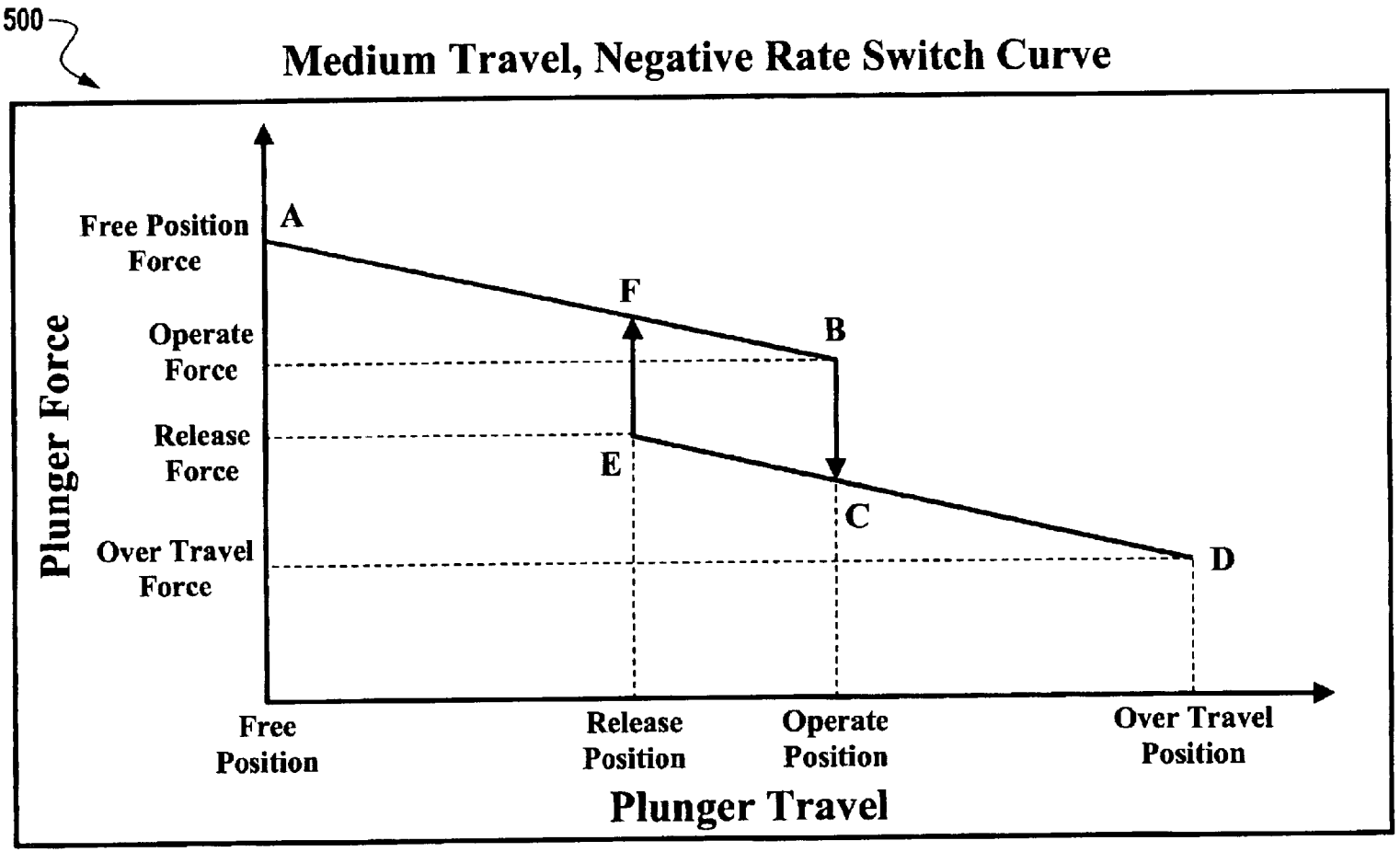
FIG. 5 illustrates a graph depicting a plunger force-deflection curve for a medium travel negative rate switch apparatus in accordance with an embodiment of the present invention.

Embodiments disclosed herein are directed toward an apparatus and method for decreasing plunger force with increasing plunger travel, or negative spring rate, switch apparatus that avoids the creep-type opening of the moveable common contact when actuated by slow moving flexible actuators. FIG. 5 illustrates a graph 500 of a plunger force-deflection curve for a medium travel, negative rate apparatus, in accordance with one embodiment of the present invention. In graph 500 of FIG. 5, the switch plunger force is at the highest value at the free position (point A) and decreases in linear fashion to the operate position (point B).

At point B the common moveable contact "snaps-over" from the normally closed stationary contact to the normally open stationary contact while the plunger force drops suddenly from point B down to point C. As the switch plunger is further depressed the plunger force decreases along the line CD for the remaining movement of the switch plunger. It is intended that the plunger force at the full over travel position D remain positive so the switch apparatus will return the switch plunger back along curve DCEFA as the plunger is slowly released.

Figure 6:
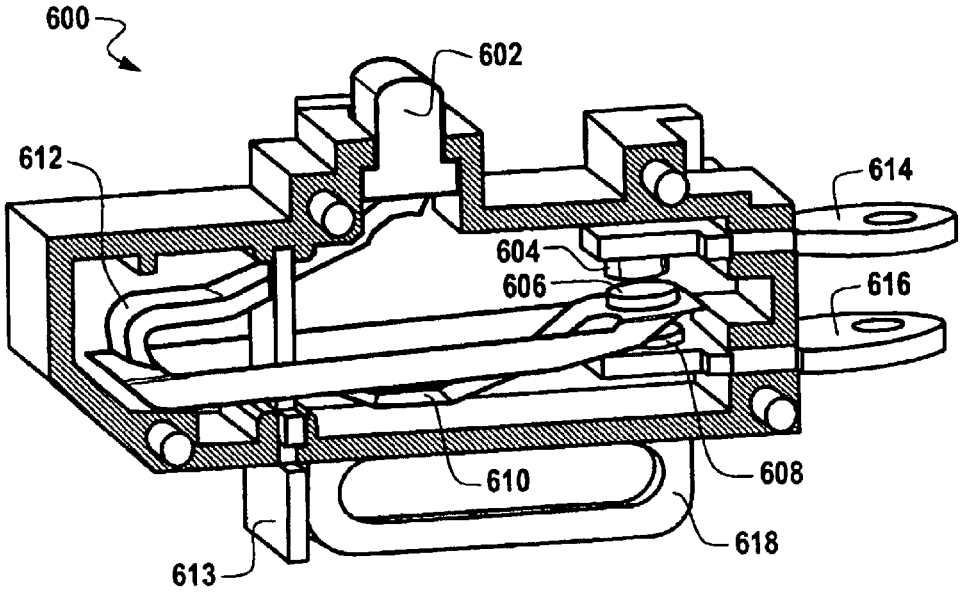
FIG. 6 is a view of the assembled snap acting switch arrangement in the "at rest" or free position, in accordance with an embodiment of the present invention.

FIG. 6 is a view of an assembled snap acting switch apparatus 600 in an "at rest" or free position, in accordance with an embodiment of the present invention. FIG. 6 illustrates a snap spring assembly 610 in association with a plunger 602, a stationary anchor 613, and an internal actuating lever 612. Switch apparatus 600 also includes a common moveable contact 606 that can press against a lower normally closed stationary contact 608. The configuration depicted in FIG. 6 illustrates the "at rest" or free position of the switch apparatus 600. Additionally, FIG. 6 depicts a normally open terminal 614, a normally closed terminal 616 and a mounting means 618, which allows the switch position to be varied relative to a resilient actuator and fixed with a threaded fastener.

Figure 7:
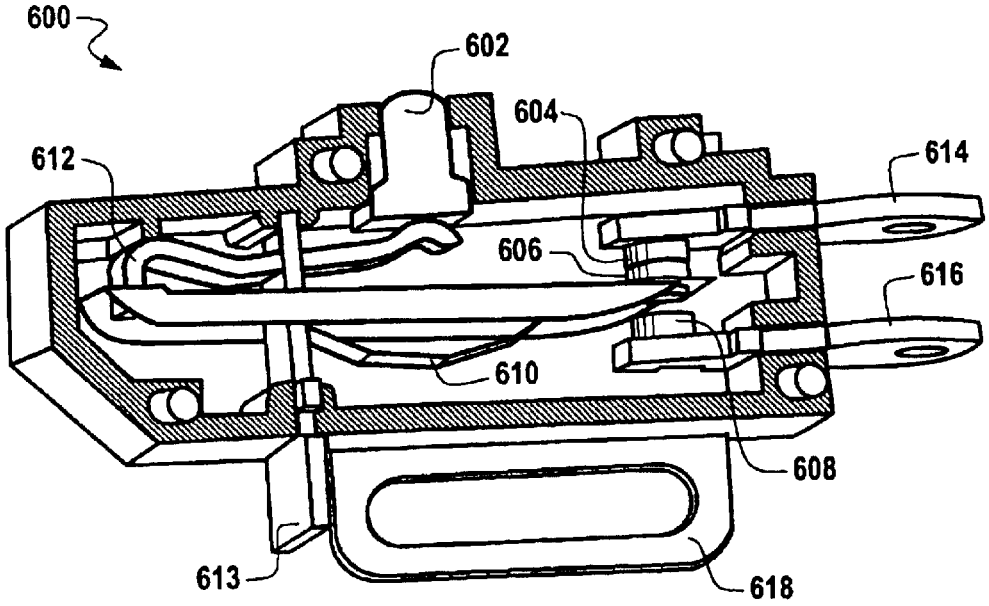
FIG. 7 is a view of the assembled snap acting switch arrangement in an actuated condition, in accordance with an embodiment of the present invention.
Figure 8:
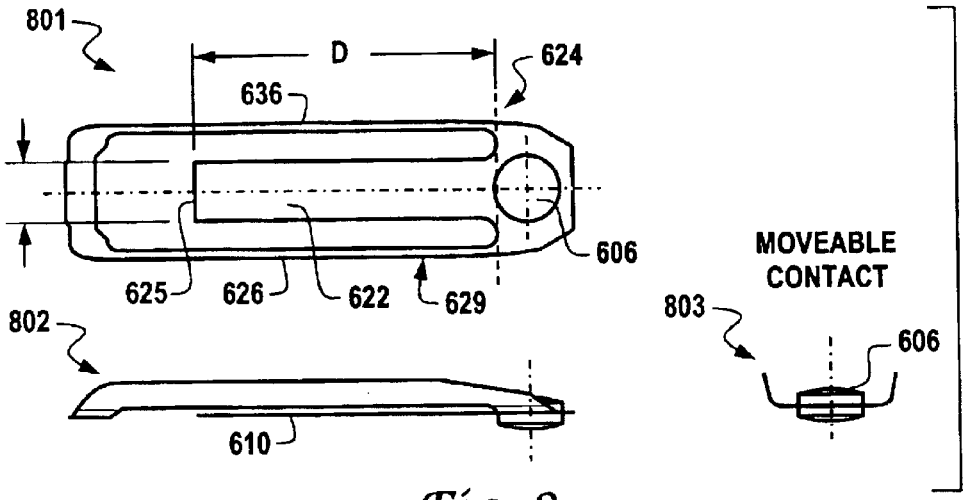
FIG. 8 is a pictorial diagram depicting the top, side, and end view of the snap spring geometry with moveable contact attached, in accordance with an embodiment of the present invention.
Figure 9:
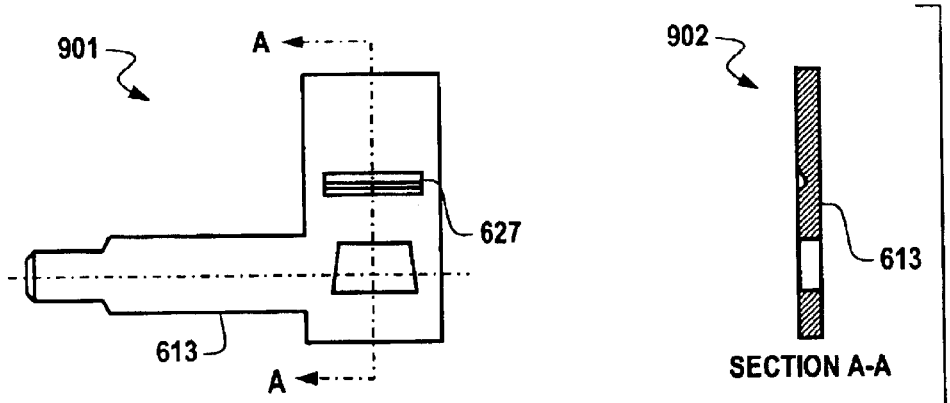
FIG. 9 is a pictorial diagram depicting a side and end view of the stationary anchor, in accordance with an embodiment of the present invention.
Figure 10:
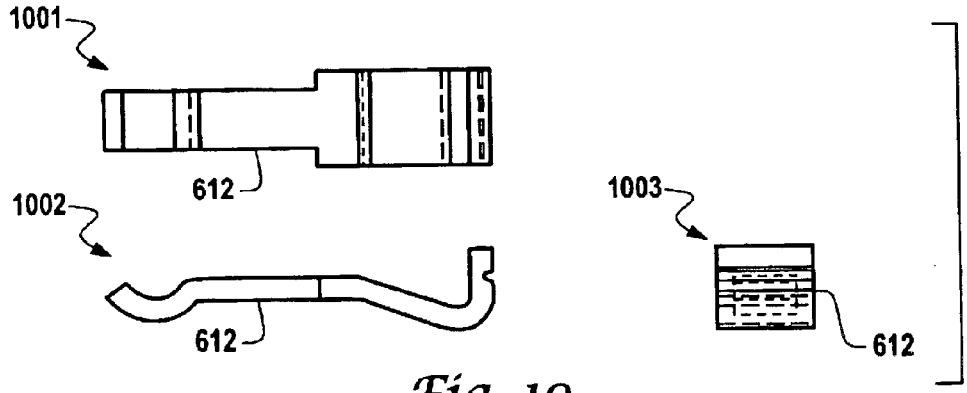
FIG. 10 is a pictorial diagram illustrating the top, side, and end view of an internal actuating lever, in accordance with an embodiment of the present invention.

FIG. 7 illustrates a view of the assembled snap acting switch apparatus 600 in an actuated condition, in accordance with an embodiment of the present invention. FIG. 8 illustrates a pictorial diagram depicting respective top, side, and end views 801, 802, and 803 of the snap spring geometry with moveable contact 606 attached, in accordance with an embodiment of the present invention. FIG. 9 illustrates a pictorial diagram depicting respective side and end views 901 and 902 of the stationary anchor 613, in accordance with an embodiment of the present invention. FIG. 10 illustrates a pictorial diagram illustrating respective top, side, and end views 1001, 1002, and 1003 of the internal actuating lever 613, in accordance with an embodiment of the present invention.

Figure 11:
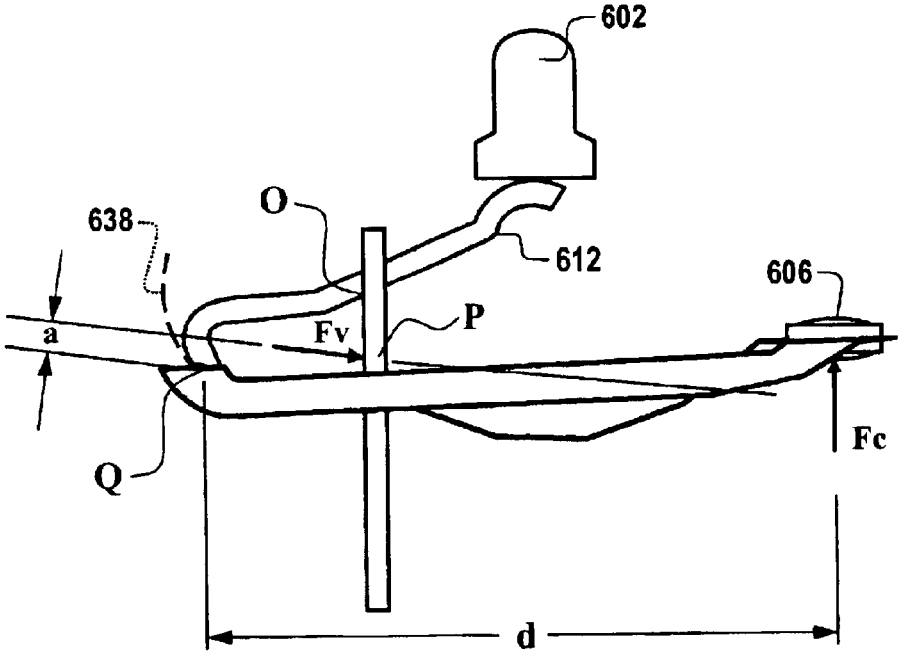
FIG. 11 illustrates a diagram illustrative of contact force and a free body spring in accordance with an embodiment of the present invention.
Figure 12:
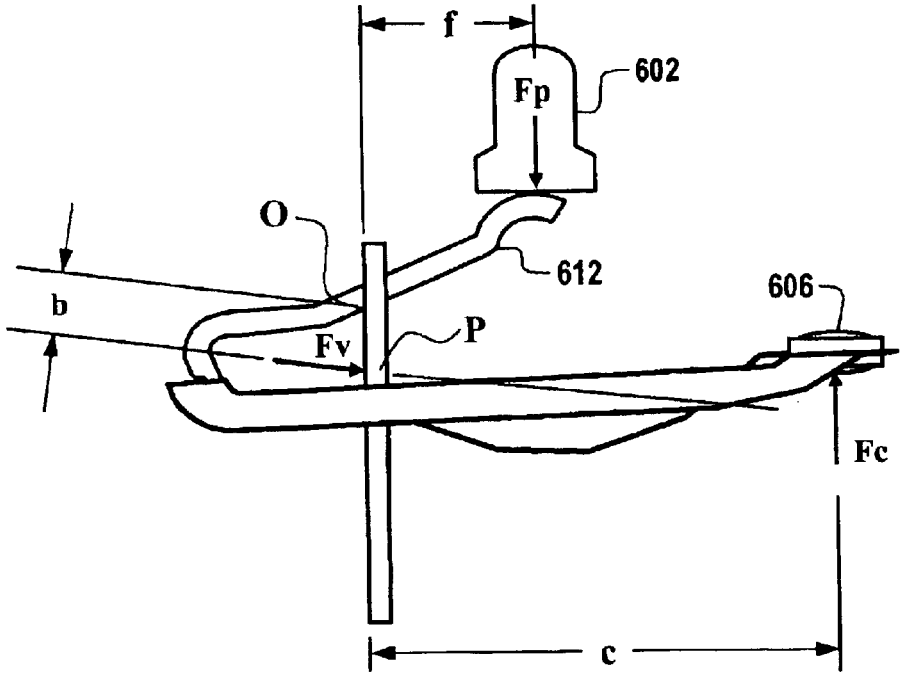
FIG. 12 illustrates a diagram illustrative of a plunger force and, free body spring and internal actuating lever in accordance with an embodiment of the present invention.

FIG. 11 illustrates a diagram illustrative of contact force and a free body spring in accordance with an embodiment of the present invention. FIG. 12 illustrates a diagram illustrative of a plunger force and, free body spring and internal actuating lever in accordance with an embodiment of the present invention. Note that in FIGS. 6–12, similar or identical parts or elements are generally indicated by identical reference numerals. Thus, FIG. 6–12 can be interpreted as referring to a preferred embodiment of the present invention.

Thus, as the plunger 602 is depressed downward, the internal actuating lever 612 moves the hinged lever end of the spring geometry upward along an arc 638 as depicted in FIG. 11. This action causes additional compression of the structural center member of the snap spring. Because the compressed spring center member is installed in a post-buckled elastic condition, the magnitude and angle of the compression force vector $F_v$ depicted in FIG. 11 remains nearly constant over any additional compression experienced by the center member during the total travel of the switch plunger 602.

Views 801, 802, and 803 of FIG. 8 together indicate that the snap spring geometry possesses a wide, flat, and thin central spring member 622 that generally extends from the remaining portion of the formed spring geometry near the attached moveable contact 606 represented by dashed line 624. When the snap spring 629 is assembled into the internal stationary anchor 613 depicted in FIG. 9 and the internal actuating lever 612 of FIG. 10 to form a spring-anchor-lever assembly, the central spring member 622 is loaded into axial compression and persuaded to bend into a post-buckled elastic mode shape of second order.

The free end 625 of the central spring member 622 can be restrained by an anchor groove 627 (i.e., see FIG. 9) similar to a pin-ended column condition while the other end can be restrained from rotating because of the built-in condition to the remainder of the spring geometry loaded in tension. The two outer side leg portions 626 and 636 of the spring geometry depicted in FIG. 8 can be formed 90 degrees to the plane of the center member 622 so as to force leg portions 626 and 636 to be straight and rigid during actuation of the switch apparatus 600.

As depicted in FIG. 11, a contact force FC can be determined from a free-body of the loaded snap spring by summing moments about point Q, where the one end of the spring is held in place by a groove near one end of the internal actuating lever. The moment developed by the reaction contact force FC at a distance d from point Q must be balanced by the external compression force vector FV at a distance (i.e. see variable "a") to maintain the spring as a free-body in equilibrium. The following equation (1) can therefore be presented.

$$FC*d=FV*a \tag{1}$$

The contact force can then be solved according to equation (2) below.

$$FC=\frac{FV*a}{d} \tag{2}$$

Since the compression force FV remains nearly constant and distance "d" increases only a small percentage of its free position value, it becomes the decrease of distance "a" that contributes most to a linear decrease of the contact force as the plunger moves the internal actuating lever.

The plunger force FP can be determined from the snap spring and internal actuating lever taken together to form a free-body in equilibrium as shown in FIG. 12. The moments due to external forces are summed about the stationary anchor pivot location denoted as point O. A formulation for summing moments about point O can be solved according to equation (3) below:

$$FP*f=FV*b+FC*c \tag{3}$$

The Plunger force can be therefore solved according to equation (4) below $$FP=\frac{FV*b+FC*c}{f} \tag{4}$$

Since the magnitude and direction of the compression force FV remains nearly constant with the center member in an elastic post-buckled condition, it is the decreasing contact force FC that contributes to the decrease in the plunger force as the plunger moves through its travel range. The distance "f" from the plunger point of contact on the internal actuating lever to the stationary anchor pivot point O may or may not vary much depending on the radius of the plunger end interfacing with the top surface of the internal actuating lever.

Elastic buckling can occur in compression members having certain relative proportions for their dimensions of length, width, and thickness. Such compression members can be referred to as "slender" compared to the so-called medium-slender and stocky type columns that undergo inelastic buckling behavior. A preferred embodiment of the snap spring center member design can be of slender proportion with a length of approximately 0.585 inches, a width of 0.116 inches, and a thickness of 0.0025 inches. With the manner of loading and the type of end support conditions for the spring center member, the critical load to cause elastic buckling can be provided by the Euler formula below via equation (5):

$$P = \frac{9\pi^2 EI}{4L^2}, \text{ where} \quad (5)$$

$E$ = spring material elastic modulus of 17.35E + 06 lbs/in**2, $I$ = moment of inertia for the rectangular cross section with a 0.116 inch width and 0.0025 inch thickness; and $L$ = spring center member length of 0.585 inches.

The moment of inertia I for the rectangular cross-section depends on the spring center member width and thickness. Example dimensions can be based on a formulation of I=(0.116*0.00253)/12=1.510E-10 in4. Substituting values for modulus E, inertia I, and length L into the Euler formula yields a critical buckling load of approximately 0.170 pounds (77 grams). When the critical buckling load is reached the spring center member undergoes elastic deflection in the weak plane, in this case in the spring thickness direction.

With elastic buckling behavior, a very small increase in compressed force beyond the critical buckling load will cause a large increase in the lateral deflection of the spring center member. The objective is to compress the spring center member far enough beyond the critical buckling point so the spring center member does not try to spring back and become straight again with any dimensional tolerance variations, but yet is not forced to buckle so far as to approach impending collapse. Fortunately for slender members the elastic post-buckling state often allows for a generous amount of bending deflection or compression beyond the critical buckling point while supporting a nearly constant compression load before any collapse will occur.

The key to achieving nearly linear and negative spring rate for plunger force-deflection behavior of the switch apparatus presented in this disclosure is to maintain elastic post-buckling behavior for the spring center member. The critical buckling load as determined by the Euler formula of equation (5) above depends on the stiffness or material elastic modulus E and the dimensions (length, width, thickness) of the member undergoing buckling.

Spring center members made with identical dimensions and for example, a beryllium copper spring material, regardless of temper and ultimate strength, will critically buckle at the same compressive load. Depending on the temper and ultimate strength of the beryllium copper material, however, post-buckling behavior may be elastic for a high-strength beryllium copper and inelastic due to overstressing and excessive yielding for a low-strength beryllium copper material.

The material strength (e.g., temper) and physical dimensions of the spring center member become important design parameters in determining whether elastic post-buckling behavior is maintained. Utilizing the preferred dimensions for the switch presented in this disclosure, a maximum bending stress of 130,000 lbs/in2 can develop at the outer surface of the spring center member thickness during the total travel of the plunger. Heat-treated beryllium copper spring material C17200, for example, with a full hard material temper (TD04) also happens to possess an elastic limit stress (i.e., proportional limit) of approximately 130,000 lbs/in2.

Limiting the maximum bending stress developed within the spring center member to stay at or below the elastic limit stress for the spring material is one way to maintain elastic post-buckling behavior. However some inelastic yielding of the outer fibers of the spring center member thickness can be tolerated. When the spring thickness is increased from 0.0025 inches to 0.0030 inches the maximum bending stress in the spring center member increases to 150,000 lbs/in**2 in a small region where the maximum amount of spring center member bow occurs. Outer fibers of the spring thickness are stressed beyond the elastic limit but the bulk of the spring thickness at this high stress location remains elastically stressed to provide for elastic post-buckling behavior.

The switch apparatus disclosed herein provides a negative plunger force deflection spring rate that is linear in slope throughout the total plunger travel. The plunger force in the plunger pre-travel and over-travel range decreases at a linear and negative rate of 250 grams/inch.

The switch apparatus provides a plunger force at free position of 38 grams, a full over-travel position return force of 18 grams, a pre-travel of 1 millimeter, and a total travel of 2 millimeters. The moveable contact air gap of 0.38 millimeter (0.015 inch) is reasonably large, the differential travel is 0.19 millimeter (0.0074 inch), and the drop in plunger force from operate point B to point C is a desirably low 1.40 grams.

The moveable contact undergoes 4 degrees of angular rotation combined with horizontal translation of over 0.25 millimeter (0.010 inch) during total plunger movement to provide for good wiping action of the moveable contact on the stationary contact surface. The amount of rocking and sliding action of the moveable contact aids weld-breaking ability and helps maintain electrical contact continuity.

The flat stationary anchor design allows for a low cost, stamped part that can be produced with tight tolerance control of the part dimensions. The spring design does not require forming of the center member, therefore, tight tolerance control of the spring center member length is possible. The flat spring design yields a switch apparatus with less force variation as compared to an over center type mechanism with a formed center member. The option to use mill-hardened spring material eliminates the cost of heat-treating the spring to increase strength and also avoids variation in the physical and mechanical properties for the spring that are introduced by a heat treatment process.

When actuated by a compatibly designed resilient actuator, the switch has two stable states of equilibrium, one at the free position and the other at the full over travel position for the plunger. The bi-stable mode of actuation eliminates the creep-like opening of the contacts as the plunger moves rapidly through the conventional operate and release positions. The fast plunger actuation improves electrical contact performance by decreasing dead break, arcing, intermittent non-contact, and welding at the electrical contact interface. Since the switch apparatus is always at one of the two stable positions of free position or full over travel, the two plunger positions where the contact force is the greatest, the switch is capable of long electrical contact life.

The maximum bending stress developed in the spring center member along with the range of bending stress experienced during plunger actuation are both low enough to provide for an infinite mechanical life of the snap spring without fracture. The spring rate and maximum operate force at free position can be easily altered by using a spring of a different thickness. For example a thinner spring of 0.0022 inch thickness provides a negative spring rate of 170 grams/inch, a maximum free position operate force of 26 grams and a minimum return force of 12 grams. A 0.0030 inch spring provides a negative rate of 430 grams/inch, a maximum free position operate force of 66 grams, and a minimum return force of 31 grams.

Figure 13:
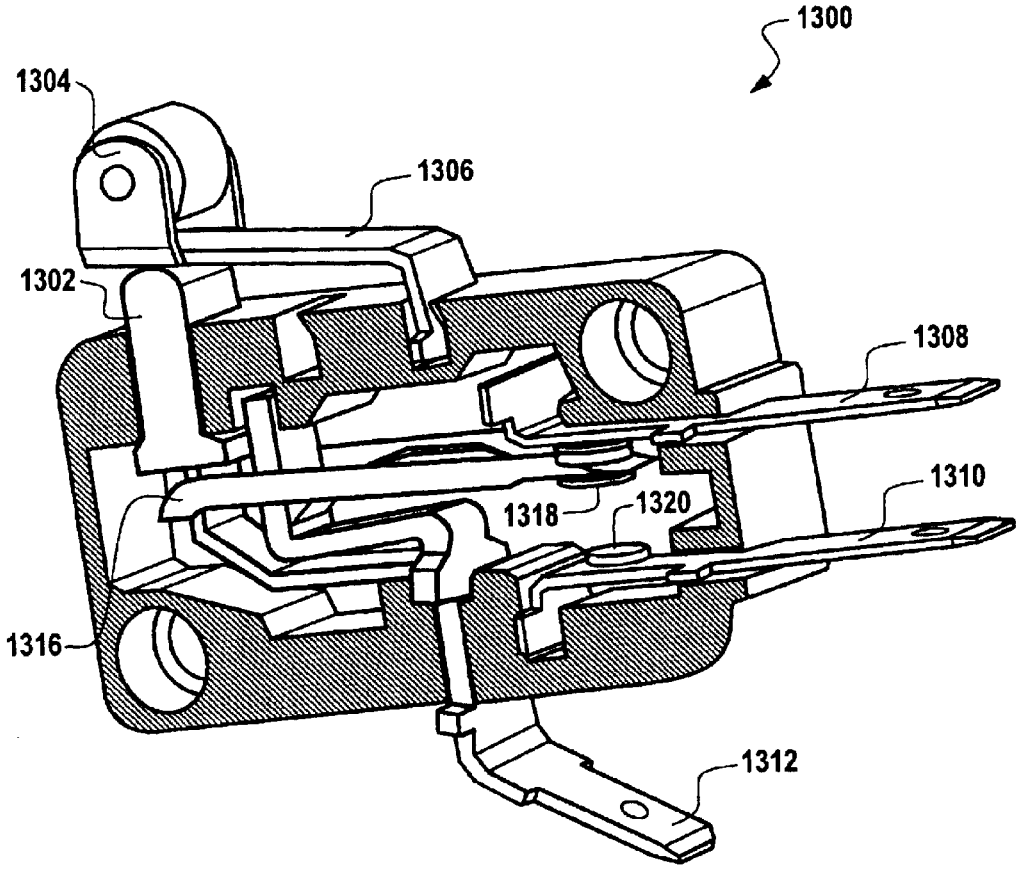
FIG. 13 illustrates an over-center type snap-acting switch apparatus with negative rate, non-linear plunger force displacement in accordance with an alternative embodiment of the present invention.
Figure 14:
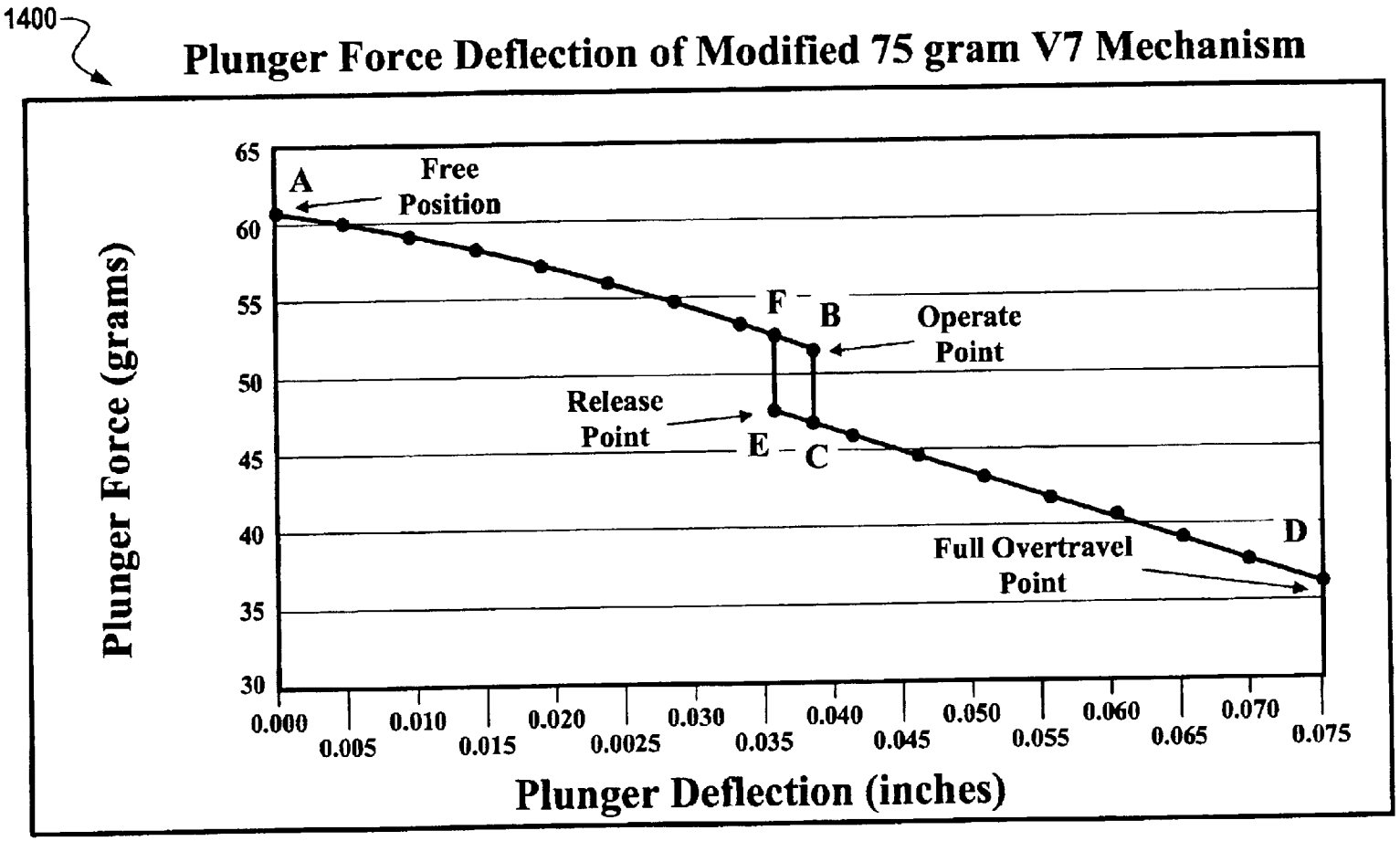
FIG. 14 illustrates a graph illustrative of plunger force displacement of an over-center type snap-acting switch apparatus in accordance with an alternative embodiment of the present invention.

Alternative embodiments of the switch apparatus are possible by modifying design parameters a, b, c, d, and f of FIGS. 11 and 12. Unlike the preferred embodiment of FIGS. 6–12, such alternative embodiments can produce non-linear plunger force displacement curves. The plunger force displacement characteristics of a Honeywell V7 switch apparatus, for example, an over-center type snap acting switching apparatus (e.g. refer to FIG. 13) can be altered to produce plunger force travel characteristics as depicted in FIG. 14. FIG. 13 generally illustrates an over-center type snap-acting switch apparatus 1300 with negative rate, non-linear plunger force displacement in accordance with an alternative embodiment of the present invention.

Figure 4:
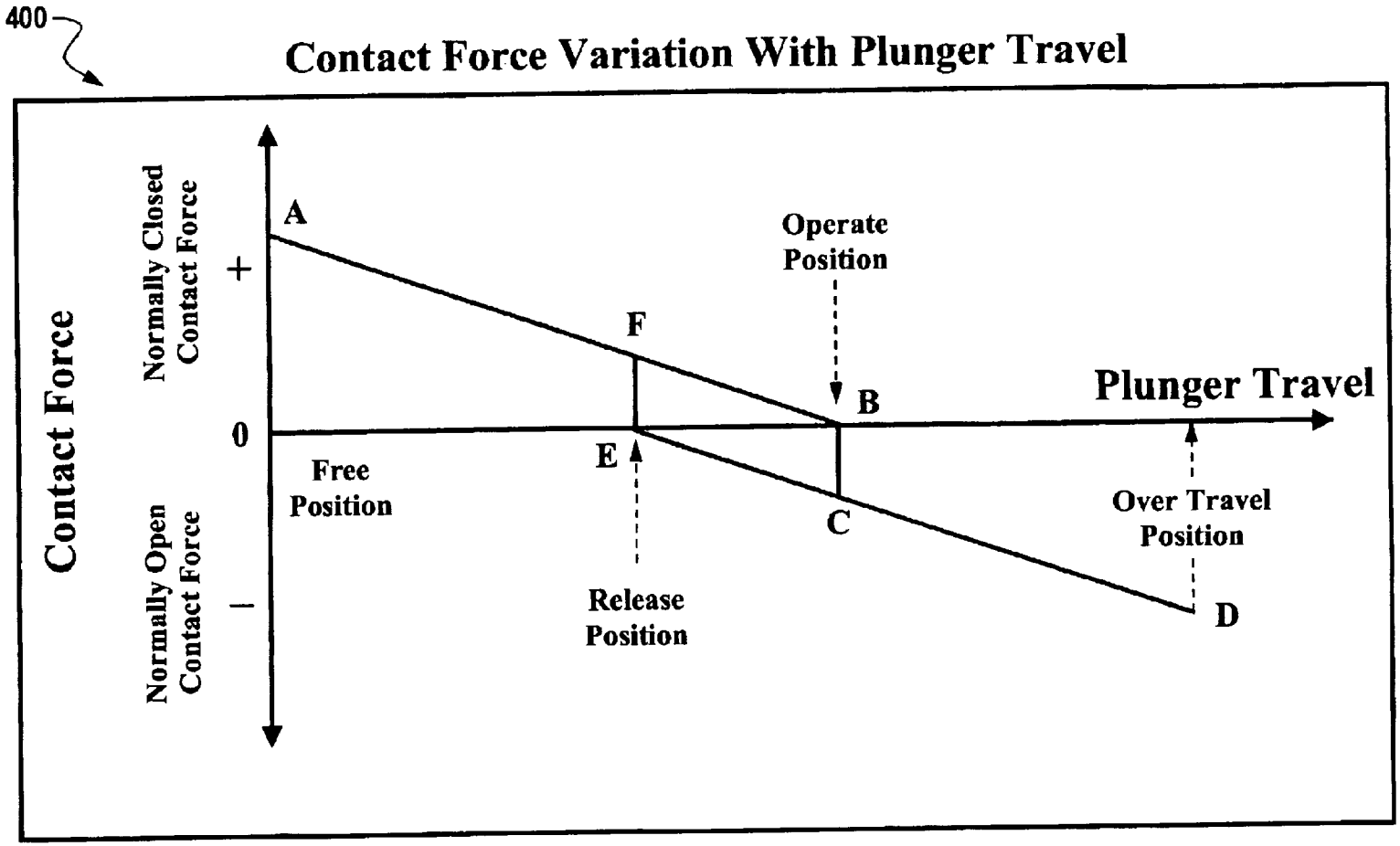
Fig. 4 (Prior Art)
FIG. 4 illustrates a graph depicting a contact force, in accordance with an embodiment of the present invention.

Switch apparatus 1300 generally includes a plunger 1302, a roller 1304, an external lever 1306, a normally closed (NC) terminal 1308 and a normally open (NO) terminal 1310. In addition, switch apparatus 1300 includes a common terminal 1312. A snap acting spring 1316 is connected to moveable contact 1318, which can come into contact with stationary contact 1320 (i.e., an NO terminal). At the free position (i.e. point A), the plunger force is at a maximum. Recall that contact force against the normally closed stationary contact is at a maximum when the mechanism is at its free position (i.e., refer to FIG. 4). Once the actuating force exceeds the free position force, the plunger begins to move with a decreasing resistance. When the plunger reaches the operate position, point B, the contact force FC (i.e., see FIGS. 11 and 12) drops to zero and the snap-spring assembly accelerates from the normally closed stationary contact to the normally open stationary contact. At the same time, the force resisting plunger movement drops to point C (i.e., see FIG. 14).

As the plunger is further depressed, the resisting force continues to drop until it reaches a minimum at the over travel position, point D. The contact force against the normally open stationary contact is a maximum when the mechanism is in the over-travel position. As the plunger is released, the force resisting the plunger follows the curve, DCEFA, depicted in graph 1400 of FIG. 14.

Figure 1:
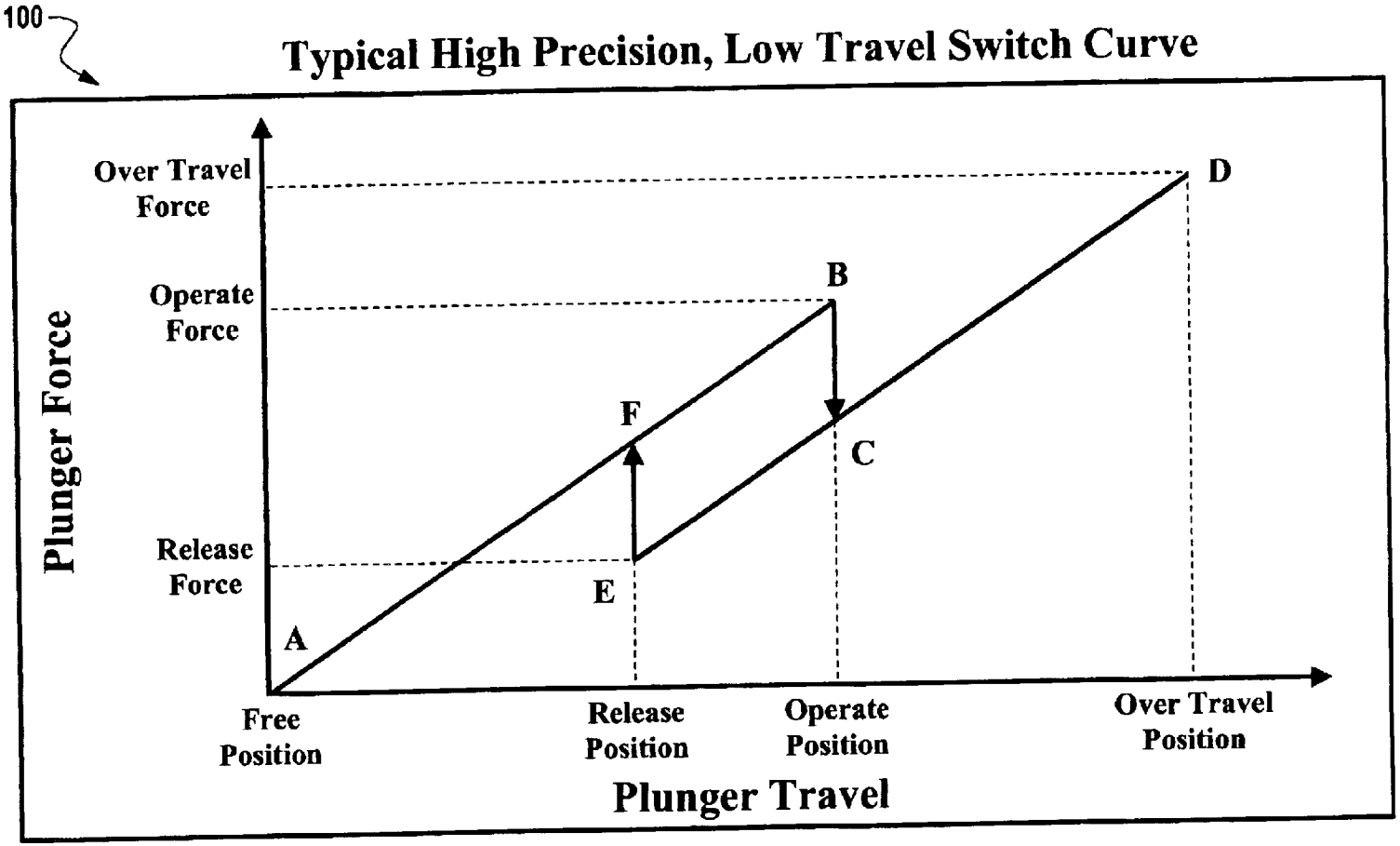
Fig. 1 (Prior Art)
FIG. 1 illustrates a prior art force displacement graph depicting deflection behavior at a switch plunger.
Figure 2:
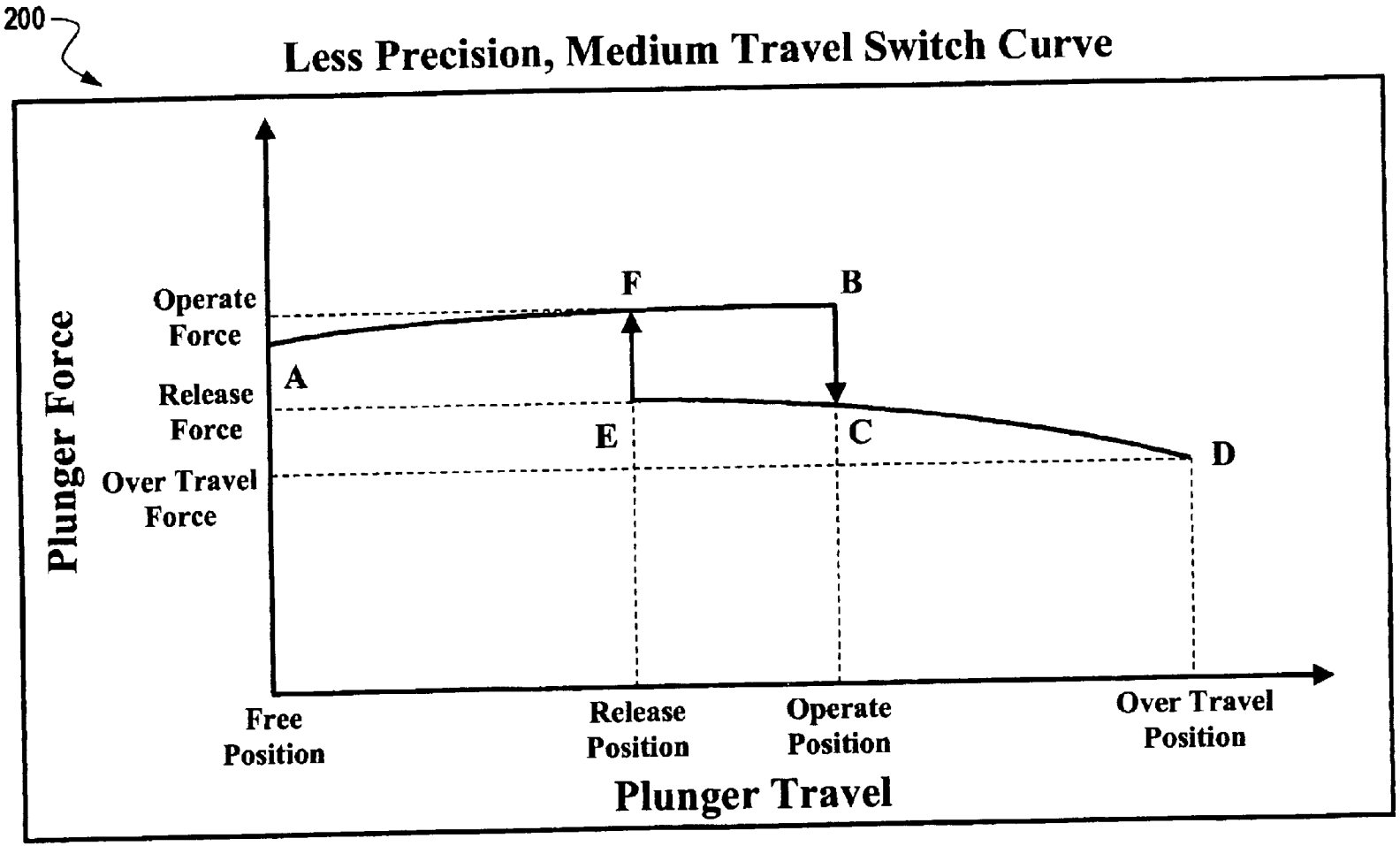
Fig. 2 (Prior Art)
FIG. 2 illustrates a prior-art force displacement graph depicting force-deflection behavior at a switch plunger.
Figure 3:
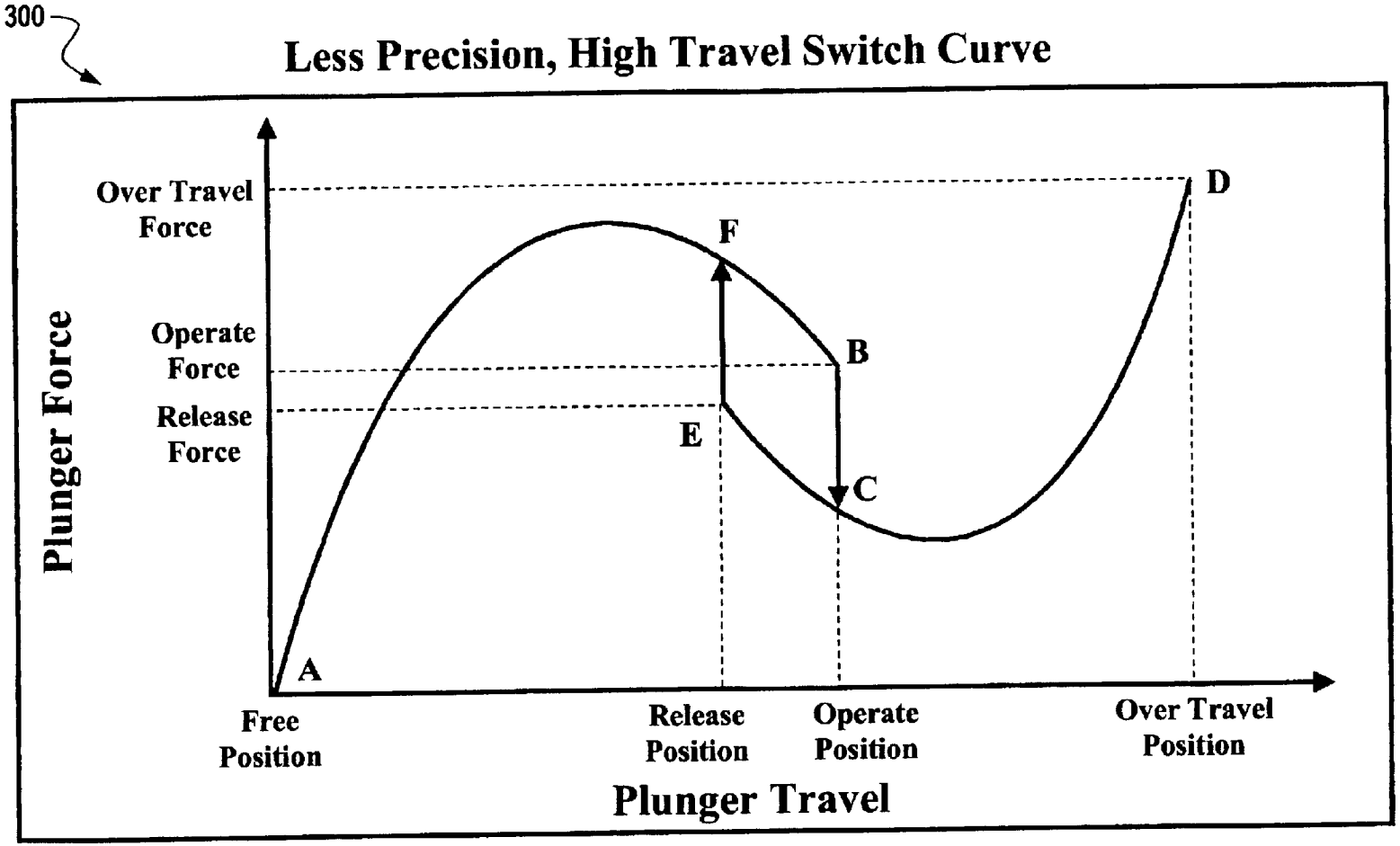
Fig. 3 (Prior Art)
FIG. 3 illustrates a prior art force displacement graph depicting a force-deflection curve representative of a high plunger travel switch design.

Despite the non-linear plunger force travel characteristics, a negative rate switch apparatus as disclosed herein with respect to preferred and/or alternative embodiments can be used to respond to stimuli generated by gravity, magnets, airflow, acceleration, pressure, buoyancy, and temperature. All of the aforementioned actuating stimuli are resilient in nature and can vary indefinitely at magnitudes that are slightly below the operate force or slightly above the release force (e.g., refer to FIGS. 1, 2, and 3). Utilizing a positive rate switch in such applications can result in unreliable and unpredictable switching performance. When actuated directly by an operator, a negative rate plunger force displacement will provide a greater degree of tactile feedback. It should be noted that the non-linear plunger force travel characteristics of this negative rate switch apparatus will result in a larger control band than that which can be obtained using the linear plunger force travel characteristics of the preferred embodiment of the mechanism.

The snap-action switch apparatus described herein thus does not move until a required actuation or de-actuation force has been attained. When the actuating force is resilient in nature and of an appropriate rate, the switch apparatus moves in a continuous, uninterrupted motion from one position of stability to another. The snap-action switch apparatus described herein has near linear, negative rate force-deflection behavior at the switch plunger. For a negative rate switch, the highest plunger force occurs at the free position and the lowest plunger force occurs at the full over-travel position.

Switch contact force is a maximum when the plunger is in either the free position or the full over travel position. When the free position plunger force of a negative rate switch is overcome by a resilient actuating force of an appropriate rate the switch plunger can move without interruption through its total range of travel. Likewise, once the resilient actuating force drops slightly below the full over-travel plunger force, the negative rate switch overcomes the resilient actuating force and returns the plunger to free position without interruption.

The embodiments and examples set forth herein are presented to best explain the present invention and its practical application and to thereby enable those skilled in the art to make and utilize the invention. Those skilled in the art, however, will recognize that the foregoing description and examples have been presented for the purpose of illustration and example only. Other variations and modifications of the present invention will be apparent to those of skill in the art, and it is the intent of the appended claims that such variations and modifications be covered.

The description as set forth is not intended to be exhaustive or to limit the scope of the invention. Many modifications and variations are possible in light of the above teaching without departing from the scope of the following claims. It is contemplated that the use of the present invention can involve components having different characteristics. It is intended that the scope of the present invention be defined by the claims appended hereto, giving full cognizance to equivalents in all respects.

What is claimed is:

1. A switch apparatus, comprising:

a plunger associated with an actuating lever, a stationary anchor, a moveable contact, and at least two stationary contacts, wherein one of said at least two stationary contacts comprises a normally open contact and another of said at least two stationary contacts comprises a normally closed contact; and a snap-spring assembly reactive to said actuating lever, wherein said snap-spring assembly is assembled into said stationary anchor and said actuating lever to form a spring-anchor-lever assembly thereof including a central spring member loaded into an axial compression and persuaded to bend into a post-buckled elastic mode shape thereof to form a switch apparatus in which said moveable and said at least two stationary contacts are responsive to an actuating force derived from said snap-spring assembly.

2. The apparatus of claim 1 wherein a downward depression of said plunger causes said actuating lever via an actuating force to move a hinged portion of said actuating lever upward along an arc thereby causing compression of said central spring member, resulting in a snap-action contact between said moveable contact and said at least two stationary contacts for completion of an electrical circuit thereof.

3. The apparatus of claim 1 wherein said switch apparatus moves in a continuous uninterrupted motion from a first position of stability to a second position of stability when said actuation force is resilient and of a desired rate.

4. The apparatus of claim 1 wherein said switch apparatus comprises a negative-rate switch, wherein a highest plunger force occurs at a free position and a lowest plunger force occurs at a full over-travel position thereof.

5. The apparatus of claim 4 wherein said switch apparatus comprises a switch contact force at a maximum point when said plunger is in said free position.

6. The apparatus of claim 4 wherein said switch apparatus comprises a switch contact force at a maximum point when said plunger is at said full over-travel position.

7. The apparatus of claim 4 wherein said plunger moves without interruption through a full range of travel thereof when a free position plunger force is overcome by a resilient actuating force of an appropriate rate.

8. The apparatus of claim 4 wherein said negative-rate switch overcomes a resilient actuating force and returns said plunger to a free position without interruption when said resilient actuating force of an appropriate rate drops slightly below a full over-travel plunger force thereof.

9. The apparatus of claim 1 wherein said switch apparatus provides a negative plunger force deflection spring rate that is linear in slope throughout a total plunger travel.

10. A switch apparatus, comprising:

a plunger associated with an actuating lever, a stationary anchor, a moveable contact, and at least two stationary contacts, wherein one of said at least two stationary contacts comprises a normally open contact and another of said at least two stationary contacts comprises a normally closed contact; and a snap-spring assembly reactive to said actuating lever, wherein said snap-spring assembly is assembled into said stationary anchor and said actuating lever to form a spring-anchor-lever assembly thereof including a central spring member loaded into an axial compression and persuaded to bend into a post-buckled elastic mode shape thereof to form a switch apparatus in which said moveable and said at least two stationary contacts are responsive to an actuating force derived from said snap-spring assembly; and wherein a downward depression of said plunger causes said actuating lever via an actuating force to move a hinged portion of said actuating lever upward along an arc thereby causing compression of said central spring member, resulting in a snap-action contact between said moveable contact and said at least two stationary contacts for completion of an electrical circuit thereof.

11. A switching method, comprising the steps of:

associating a plunger with an actuating lever, a stationary anchor, a moveable contact, and at least two stationary contacts, wherein one of said at least two stationary contacts comprises a normally open contact and another of said at least two stationary contacts comprises a normally closed contact; and configuring a snap-spring assembly reactive to said actuating lever, wherein said snap-spring assembly is assembled into said stationary anchor and said actuating lever to form a spring-anchor-lever assembly thereof including a central spring member loaded into an axial compression and persuaded to bend into a post-buckled elastic mode shape thereof to form a switch apparatus in which said moveable and said at least two stationary contacts are responsive to an actuating force derived from said snap-spring assembly.

12. The method of claim 11 further comprising the step of initiating a downward depression of said plunger to cause said actuating lever via an actuating force to move a hinged portion of said actuating lever upward along an arc thereby causing a compression of said central spring member, resulting in a snap-action contact between said moveable contact and said at least two stationary contacts for completion of an electrical circuit thereof.

13. The method of claim 11 wherein said switch apparatus moves in a continuous uninterrupted motion from a first position of stability to a second position of stability when said actuation force is resilient and of a desired rate.

14. The method of claim 11 wherein said switch apparatus comprises a negative-rate switch, wherein a highest plunger force occurs at a free position and a lowest plunger force occurs at a full over-travel position thereof.

15. The method of claim 14 wherein said switch apparatus comprises a switch contact force at a maximum point when said plunger is in said free position.

16. The method of claim 14 wherein said switch apparatus comprises a switch contact force at a maximum point when said plunger is at said full over-travel position.

17. The method of claim 14 wherein said plunger moves without interruption through a full range of travel thereof when a free position plunger force is overcome by a resilient actuating force of an appropriate rate.

18. The method of claim 14 wherein said negative-rate switch overcomes a resilient actuating force and returns said plunger to a free position without interruption when said resilient actuating force of an appropriate rate drops slightly below a full over-travel plunger force thereof.

19. The method of claim 11 wherein said switch apparatus provides a negative plunger force deflection spring rate that is linear in slope throughout a total plunger travel.

20. The method of claim 11 further comprising the steps of:

configuring said spring-anchor-lever assembly to comprise at least one spring center member, wherein elastic post-buckling is maintained for stabilization thereof.

* * * * *